US007261386B2

(12) United States Patent
Hung

(10) Patent No.: US 7,261,386 B2
(45) Date of Patent: Aug. 28, 2007

(54) METHOD FOR REDUCING THERMAL ACCUMULATION DURING INKJET PRINTING

(75) Inventor: Hao-Feng Hung, Taipei (TW)

(73) Assignee: BenQ Corporation, Gueishan, Tao-Yuan Hsien (TW)

( * ) Notice: Subject to any disclaimer, the term of this patent is extended or adjusted under 35 U.S.C. 154(b) by 72 days.

(21) Appl. No.: 11/307,423

(22) Filed: Feb. 7, 2006

(65) Prior Publication Data

US 2006/0109293 A1 May 25, 2006

Related U.S. Application Data

(62) Division of application No. 10/605,501, filed on Oct. 3, 2003, now Pat. No. 7,036,901.

(51) Int. Cl.
*B41J 29/38* (2006.01)

(52) U.S. Cl. ..... 347/14; 347/17

(58) Field of Classification Search ..... 347/14, 347/17, 19

See application file for complete search history.

(56) References Cited

U.S. PATENT DOCUMENTS 5,458,424 A 10/1995 Kato et al.
6,211,970 B1 * 4/2001 Cornell et al. ..... 358/1.9
6,447,087 B1 9/2002 Kao et al.
6,676,239 B2 * 1/2004 Kao et al. ..... 347/17
2003/0156147 A1 8/2003 Misumi

FOREIGN PATENT DOCUMENTS

CN 1353399A A 6/2002
DE 101 48 840 A1 5/2002

* cited by examiner

*Primary Examiner*—Thinh Nguyen
(74) *Attorney, Agent, or Firm*—Winston Hsu

(57) ABSTRACT

A method for printing an image on a printing medium with an inkjet printing device includes providing data representative of an original image, calculating a total heat weighting value for the original image to indicate a degree of heat accumulation for the original image, and comparing the total heat weighting value to R distinct reference values. The method also includes selecting M image masks to be used to mask the original image, wherein a value of M is chosen according to comparison results between the total heat weighting value and the R reference values; masking the original image with the M image masks to produce M sub-images; and printing the M sub-images successively on the printing medium with a plurality of nozzles for superimposing the M sub-images on the printing medium, whereby the original image is printed on the printing medium.

20 Claims, 11 Drawing Sheets

| | Initial | Single"1" | Successive"1" | Single"0" | Successive"0" |
|---|---|---|---|---|---|
| Heat weighting value | 0 | +1 | +1 | +0 | −1 |

Fig. 4

| W(Total heat weighting value) | W<R1 | R1≦W<R2 | R2≦W<R3 | ..... |
|---|---|---|---|---|
| Number of masks | 1 | 2 | 3 | ..... |

Fig. 6

METHOD FOR REDUCING THERMAL ACCUMULATION DURING INKJET PRINTING

CROSS REFERENCE TO RELATED APPLICATIONS

This application is a division of U.S. application Ser. No. 10/605,501 filed Oct. 3, 2003 now U.S. Pat. No. 7,036,901, the contents of which are hereby incorporated by reference.

BACKGROUND OF THE INVENTION

1. Field of the Invention

The present invention relates to inkjet printers, and more specifically, to a method for reducing thermal accumulation with inkjet printing through the use of sub-images.

2. Description of the Prior Art

Recently, the popularity of inkjet printers has increased dramatically due to their low cost and high quality. Since the price and quality are critical to the users' choices, printer vendors aggressively develop their products so that the products have lower cost and better quality so as to increase popularity and profits of their products. Therefore, developers are focusing on how to improve the performance of products under limited cost.

Most inkjet printers now use thermal inkjet printhead or piezo-electrical inkjet printhead to spray ink droplets onto a sheet of medium, such as paper, for printing. The thermal inkjet printhead includes ink, heating devices, and nozzles. The heating devices are to heat the ink to create bubbles until the bubbles expand enough to burst so that ink droplets are fired onto the sheet of paper through the nozzles and form dots or pixels on the sheet of paper. Varying the sizes and locations of the ink droplets can form different texts and graphics on a sheet of paper.

The quality of printing is closely related to the resolution provided by the printers, with higher resolutions requiring finer sizes of droplets. The size of the droplets is related to the cohesion of the ink. For instance, for droplets having identical amount of ink, ink with greater cohesion may have a smaller range of spread when they fall onto the paper, resulting in clearer and sharper printing. In the process of printing with the thermal inkjet technology, the heating elements of a printhead are activated to heat up the ink in the printhead for the creation of bubbles so that ink droplets are ejected from the nozzles onto a sheet of paper. As the temperature of the ink rises, the viscosity of the ink becomes lower. If the temperature of the ink is higher than a predetermined level, the viscosity of the ink could be abnormally low and ink droplets to be ejected would form larger dots onto the sheet of paper, resulting in a degraded quality of printing. Thus, the temperature control of the ink is a key to the improvement of the printing quality.

Please refer to FIG. 1. FIG. 1 shows a block diagram of a conventional inkjet printer 10. The inkjet printer 10 includes a central processing unit (CPU) 12, a printing controller 16, a printhead driver 18, and a printhead 20. During printing, data representative of images to be printed are fed into the inkjet printer 10. After processing of the data, the CPU 16 feeds image data 14 into the printing controller 16. The image data 14 includes information of locations, colors, and density of pixels corresponding to the images to be printed. In response to the image data 14, the printing controller 16 controls the printhead driver 18 and the printhead driver 18 causes the printhead 20 to print the images.

Please refer to FIG. 2. FIG. 2 gives an illustration of a portion of nozzles arranged on the printhead 20. For the sake of simplicity, the nozzles of the printhead 20 are represented as an array of nozzles 20'. The printhead 20 includes a plurality of nozzles and heating elements, and each of the heating elements is disposed in proximity to an associated nozzle to heat ink close to the nozzle for the ejection of ink droplets.

In the course of printing, a nozzle may eject ink droplets consecutively. The heat generated by the heating element associated with the nozzle may accumulate because consecutive triggering signals are applied to the heating element while there is no enough time for the heat produced to release completely. Besides, the ink temperature near the nozzle may also be greater than that near the other nozzles. If the heat accumulation is not well compensated, the ink temperatures near different nozzles will be different from each other. Because of the different temperatures, the ink near different nozzles will have different viscosity. The ink droplets ejected from different nozzles would be of different sizes, resulting in a degraded printing quality. Thus, temperature compensation is necessary for improving the printing quality of thermal inkjet printing.

Conventionally, there are two techniques for temperature compensation for use in inkjet printing apparatuses. In the first approach, temperature compensation is based on the temperature of the nozzles measured by a thermal resistor arranged near the nozzles. In addition, the temperature of the nozzles is determined by the variation of the resistance of the thermal resistor. However, the temperature obtained in this way is an average temperature of a part or all of the nozzles whereas the temperature of specific nozzles are unobtainable. In other words, if abnormal temperature increase is observed, it is still not possible to identify the specific nozzles that cause the temperature rise in such conventional approach. Therefore the temperature compensation actions taken may not be appropriate.

In the second approach, temperature compensation is based on predictions about heat accumulation while the predictions are made by analyzing pixels of the image desired to be printed. If the formation of the images on a sheet of printing medium requires the ejection of a large number of ink droplets corresponding to the pixels of the images, a high degree of heat accumulation is expected. Conversely, if the formation of the images on the sheet of printing medium requires the ejection of a small number of ink droplets corresponding to the pixels of the images, a low degree of heat accumulation is expected. During printing, in order to achieve temperature compensation, evaluation of energy applied to each of the nozzles is made in accordance with the predications about heat accumulation. However, during consecutive ejection of ink droplets, heat release of the nozzles is incomplete, and heat accumulation still occurs in each nozzle. Thus, the second approach is unable to effectively resolve the problem of heat accumulation in the nozzles.

SUMMARY OF THE INVENTION

It is therefore a primary objective of the claimed invention to provide a method for reducing thermal accumulation during ink jet printing in order to solve the above-mentioned problems.

According to the claimed invention, a method for printing an image on a printing medium with an inkjet printing device includes providing data representative of an original image; calculating a total heat weighting value for the original image to indicate a degree of heat accumulation for the original image; comparing the total heat weighting value to R distinct reference values, R being an integer greater than or equal to one; selecting M image masks to be used to mask the original image, wherein a value of M is chosen according to comparison results between the total heat weighting value and the R reference values, M being an integer greater than or equal to one, a first image mask being generated by: (b1) choosing contiguous groups of N nozzles to be included in a first mask, wherein each group of N nozzles included in the first mask is separated by (M−1)*N nozzles not included in the first mask, N being an integer greater than or equal to one; masking the original image with the M image masks to produce M sub-images; and printing the M sub-images successively on the printing medium with a plurality of nozzles for superimposing the M sub-images on the printing medium, whereby the original image is printed on the printing medium.

According to another preferred embodiment of the claimed invention, a method for printing an image on a printing medium with an inkjet printing device includes providing data representative of an original image; calculating a total heat weighting value for the original image to indicate a degree of heat accumulation for the original image; comparing the total heat weighting value to R distinct reference values, R being an integer greater than or equal to one; selecting M image masks to be used to mask the original image, wherein a value of M is chosen according to comparison results between the total heat weighting value and the R reference values, M being an integer greater than or equal to one, a first image mask being generated by: (c1) choosing a current nozzle to be included in the first mask; (c2) analyzing a group of M nozzles closest to the current nozzle, wherein the group of M nozzles have not been previously chosen or analyzed for inclusion in the first mask; (c3) selecting among the group of M closest nozzles a next nozzle which is farthest away from the current nozzle, and choosing the next nozzle to be included in the first mask; and (c4) repeating steps (c2) and (c3) until all nozzles have been analyzed, wherein each next nozzle is treated as the current nozzle after the next nozzle has been chosen to be included in the first mask; masking the original image with the M image masks to produce M sub-images; and printing the M sub-images successively on the printing medium with a plurality of nozzles for superimposing the M sub-images on the printing medium, whereby the original image is printed on the printing medium.

It is an advantage of the claimed invention that the original image is divided into M sub-images with the M image masks. The use of sub-images prevents an excessive amount of heat from accumulating in the ink provided to the nozzles by spreading out the nozzles used to eject ink at any one time.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 4 is a table summarizing operation of a heat accumulator according to image data to be printed.

FIG. 6 is a table showing a relationship between a total heat weighting value and a number of image masks used to produce sub-images.

DETAILED DESCRIPTION

Figure 1:
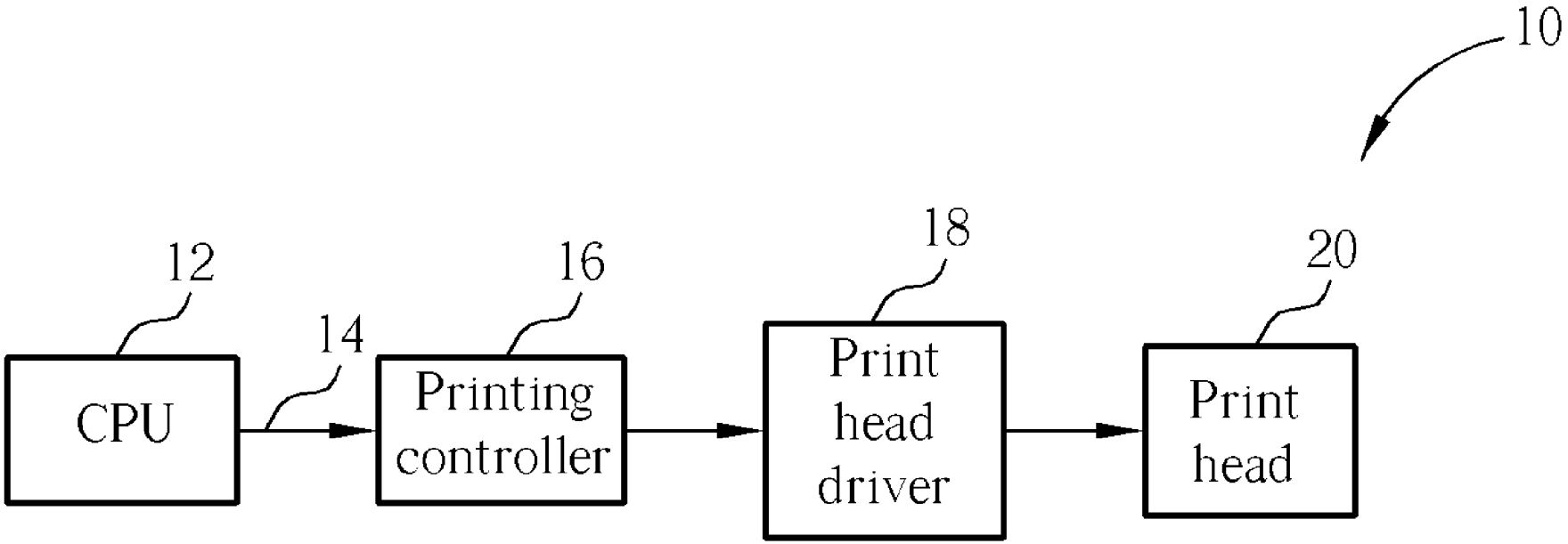
Fig. 1 Prior Art
FIG. 1 shows a block diagram of a conventional inkjet printer.
Figure 2:
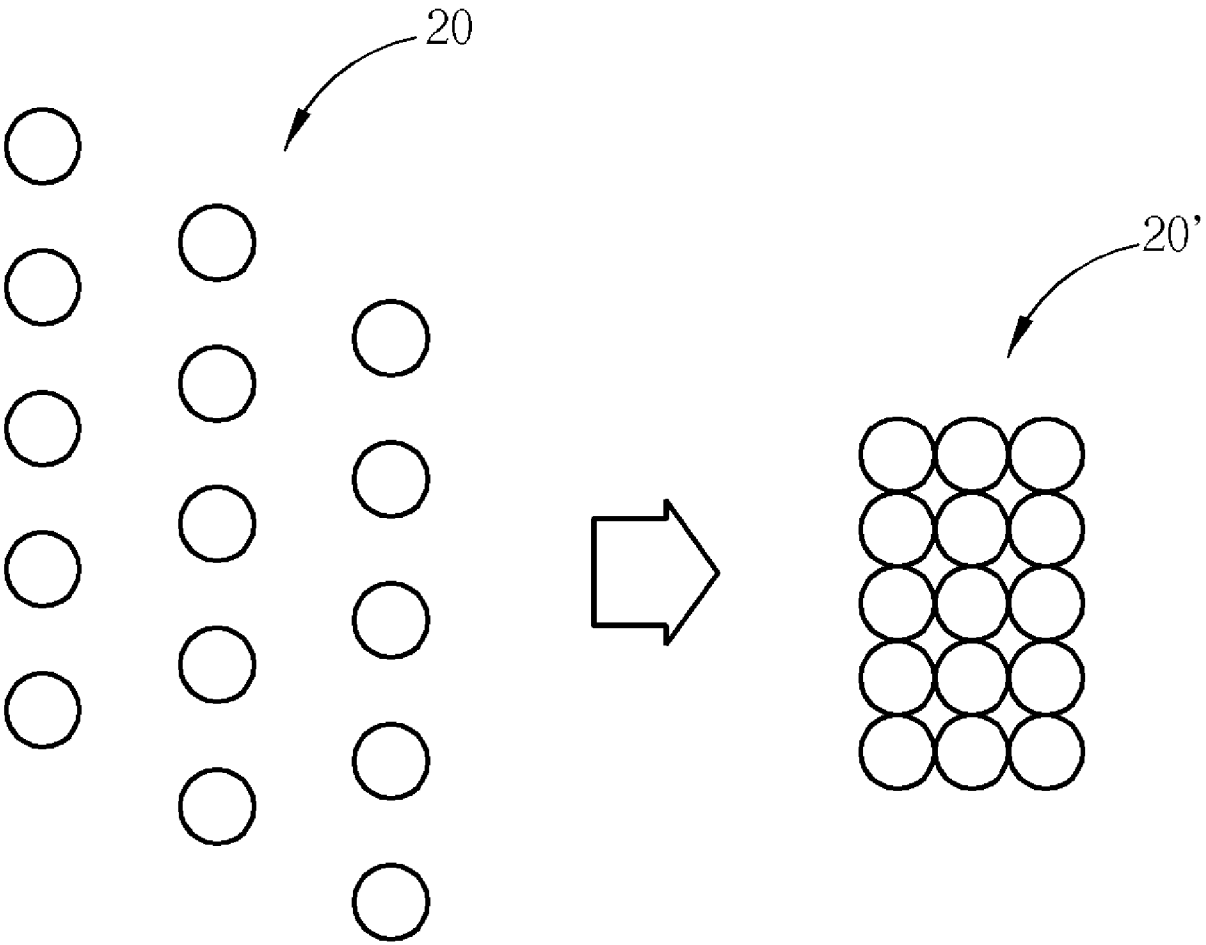
Fig. 2 Prior Art
FIG. 2 gives an illustration of a portion of nozzles arranged on the printhead.
Figure 3:
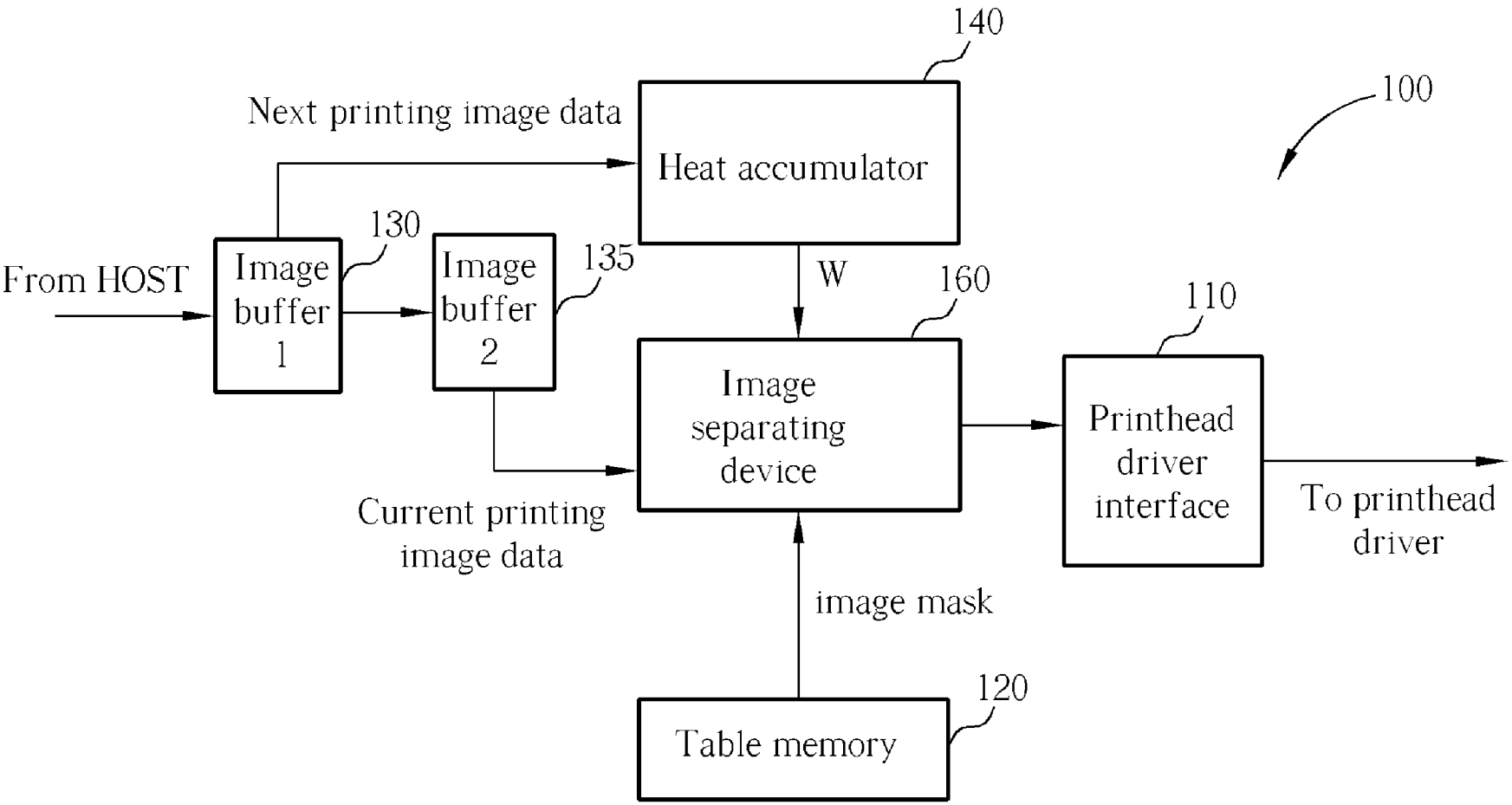
FIG. 3 shows a block diagram of a controlling device used for controlling inkjet printing according to the present invention.

Please refer to FIG. 3. FIG. 3 shows a block diagram of a controlling device 100 used for controlling inkjet printing according to the present invention. The controlling device 100 contains a first image buffer 130 and a second image buffer 135 for storing image data to be printed. A host device, such as a personal computer, sends the printing data to the first image buffer 130. Next, the first image buffer 130 sends the image data to both the second image buffer 135 and a heat accumulator 140. The heat accumulator 140 then calculates a total heat weighting value W based on a number of nozzles and a relative proximity of the nozzles that will be used to eject ink onto a printing medium during one swath of the printhead. In general, the more nozzles that are utilized to eject ink, the higher the value of the total heat weighting value W will be. The heat accumulator 140 then sends the total heat weighting value W to an image separating device 160. At the same time, the second image buffer 135 sends the image data to the image separating device 160, and the image separating device 160 divides an original image corresponding to the image data into a plurality of sub-images. Based on the magnitude of the total heat weighting value W, the image separating device 160 selects a number of image masks to use for dividing the original image into sub-images. The image masks are generated according to one or more predetermined algorithms, and the resulting image masks are stored in a table memory 120. After the image separating device 160 uses the image masks to separate the original image into the plurality of sub-images, the sub-images are sent to a printhead driver via a printhead driver interface 110.

Please refer to FIG. 4. FIG. 4 is a table summarizing operation of the heat accumulator 140 according to image data to be printed. The total heat weighting value W is a sum of heat weighting values calculated for each row of nozzles in the printhead. For each row of nozzles, both the number of nozzles ejecting ink and the relative proximity of the nozzles determines the magnitude of the heat weighting value. As FIG. 4 shows, the initial heat weighting value is equal to zero. This initial heat weighting value is then either incremented or decremented according to the printing status of a current nozzle and a previous nozzle. The current nozzle is the nozzle currently being analyzed, while the previous nozzle is the nozzle that was just analyzed. As shown in FIG. 4, a single nozzle ejecting ink (image data equal to "1") will increase the heat weighting value by a value of one. If the current nozzle and the previous nozzle are both ejecting ink, the current nozzle will also increase the heat weighting value by a value of one. On the other hand, a single nozzle not ejecting ink (image data equal to "0") will neither increase nor decrease the heat weighting value. However, if neither the current nozzle nor the previous nozzle are ejecting ink, the current nozzle will decrease the heat weighting value by a value of one. Please keep in mind that the values shown in FIG. 4 are merely used as examples, and other calculation schemes can be used by the heat accumulator 140 to calculate the total heat weighting value W.

Figure 5:
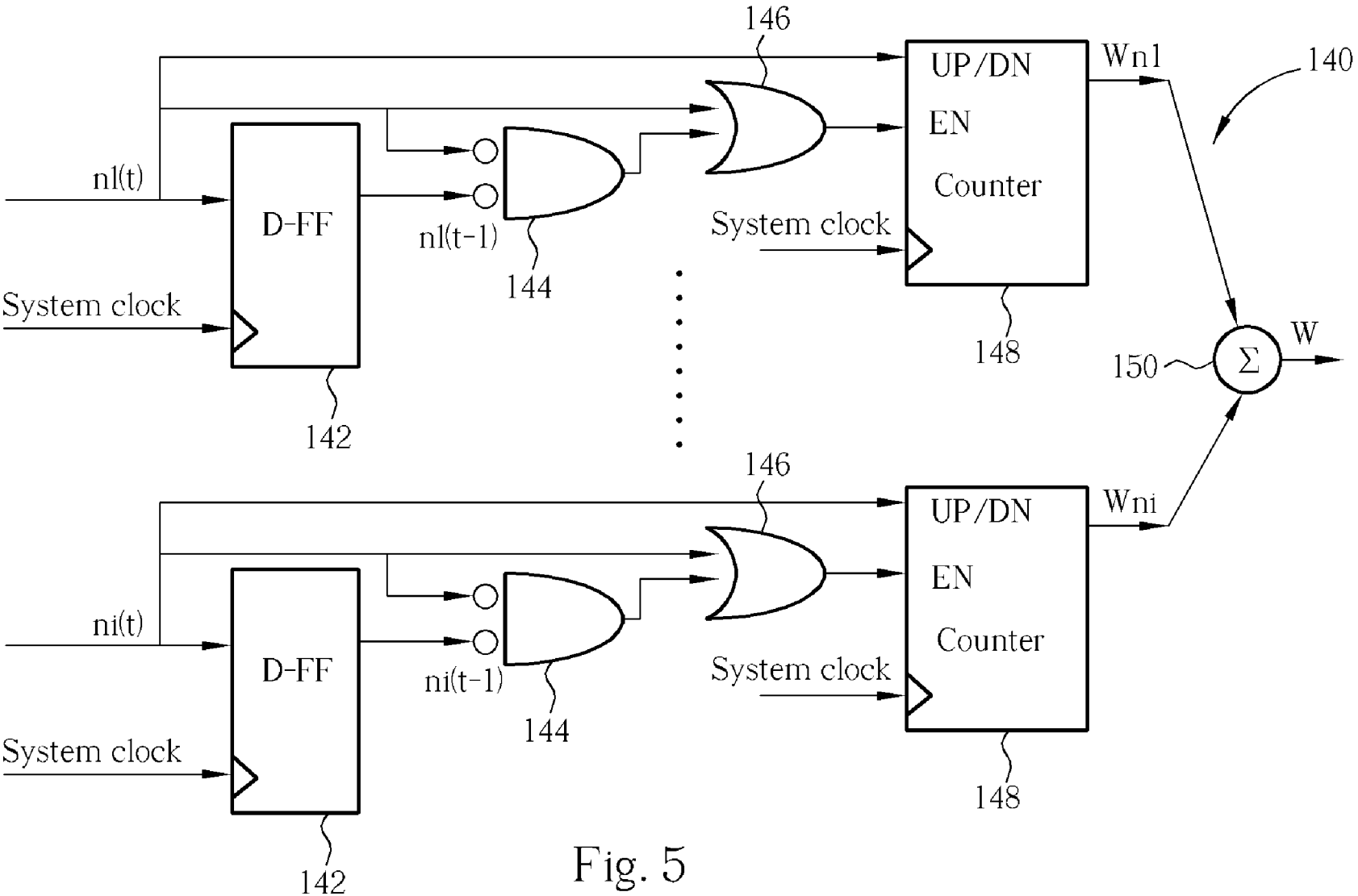
FIG. 5 is a detailed diagram of the heat accumulator.

Once the heat weighting value for each row has been calculated, all of the heat weighting values are added together to produce the total heat weighting value W. Please refer to FIG. 5 with reference to FIG. 4. FIG. 5 is a detailed diagram of the heat accumulator 140. The circuitry shown in FIG. 5 is a logical implementation of the heat accumulation table shown in FIG. 4. A summing circuit 150 is used to sum heat weighting values from all rows of nozzles of the printhead. For each row of nozzles, a D flip-flop 142, AND gate 144, OR gate 146, and up/down counter 148 are used to calculate heat weighting values. The circuitry shown in FIG. 5 calculates heat weighting values for a first row through an $i^{th}$ row of nozzles. Taking the first row as an example, n1(t) represents the image data of a current nozzle and n1(t−1) represents the image data of the previous nozzle. The up/down counter 148 receives an up/down control input based on the image data of the current nozzle. When the current nozzle is used to eject ink (image data has a value of "1"), the counter will always increase the heat weighting value Wn1. On the other hand, when the current nozzle is not ejecting ink (image data has a value of "0"), the counter will either decrease the heat weighting value Wn1 or leave it unchanged. Once all rows of nozzles have been analyzed, the heat accumulator 140 produces the total heat weighting value W.

Please refer to FIG. 6. FIG. 6 is a table showing a relationship between the total heat weighting value W and a number of image masks used to produce sub-images. The total heat weighting value W generated by the heat accumulator 140 is compared to a plurality of reference values R1, R2, R3, etc., and the number of image masks used by the image separating device 160 is determined according to the comparison results. As FIG. 6 shows, if the total heat weighting value W is less than reference value R1, only one image mask is used to generate one sub-image. In this case, the image mask includes all nozzles of the printhead and the one sub-image is exactly equal to the original image. If the total heat weighting value W is greater than or equal to reference value R1 and less than reference value R2, two image masks will be used to generate two sub-images. In this case, the first image mask will restrict a subset of nozzles from ejecting ink to produce the first sub-image. The second image mask will be a complement of the first image mask, and the second image mask will restrict the nozzles that are utilized to produce the first sub-image. Of course, three or more image masks can also be used with the present invention, and algorithms used for producing the masks will also be explained below.

Figure 7:
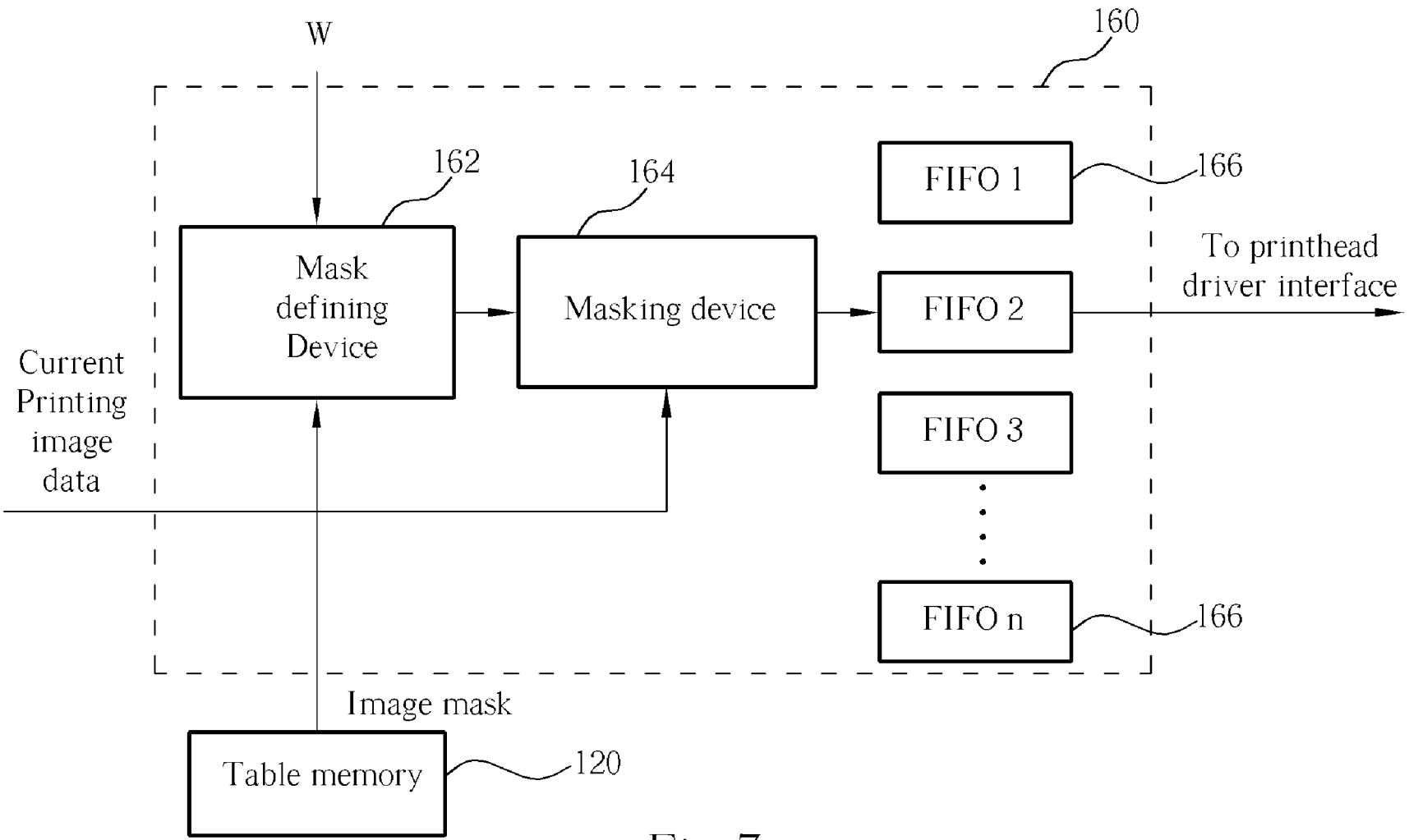
FIG. 7 is a detailed block diagram of an image separating device.

Please refer to FIG. 7. FIG. 7 is a detailed block diagram of the image separating device 160. The image separating device 160 contains a mask defining device for selecting one or more image masks from the table memory 120 based on the total heat weighting value W. The image masks are then sent to a masking device 164. The masking device 164 masks the current image data to be printed with the image masks, produces the plurality of sub-images, and stores each of the sub-images in a FIFO (first-in first-out) buffer 166. Then, one by one, the sub-images stored in the FIFO buffers 166 are sent to the printhead driver interface 110 to be printed. If more than one image mask is used to produce more than one sub-image, the image masks can be applied to the original image in any order to produce the sub-images. Furthermore, since the sub-images are superimposed on each other when printed on the printing medium, the sub-images can be printed in any order.

Figure 8:
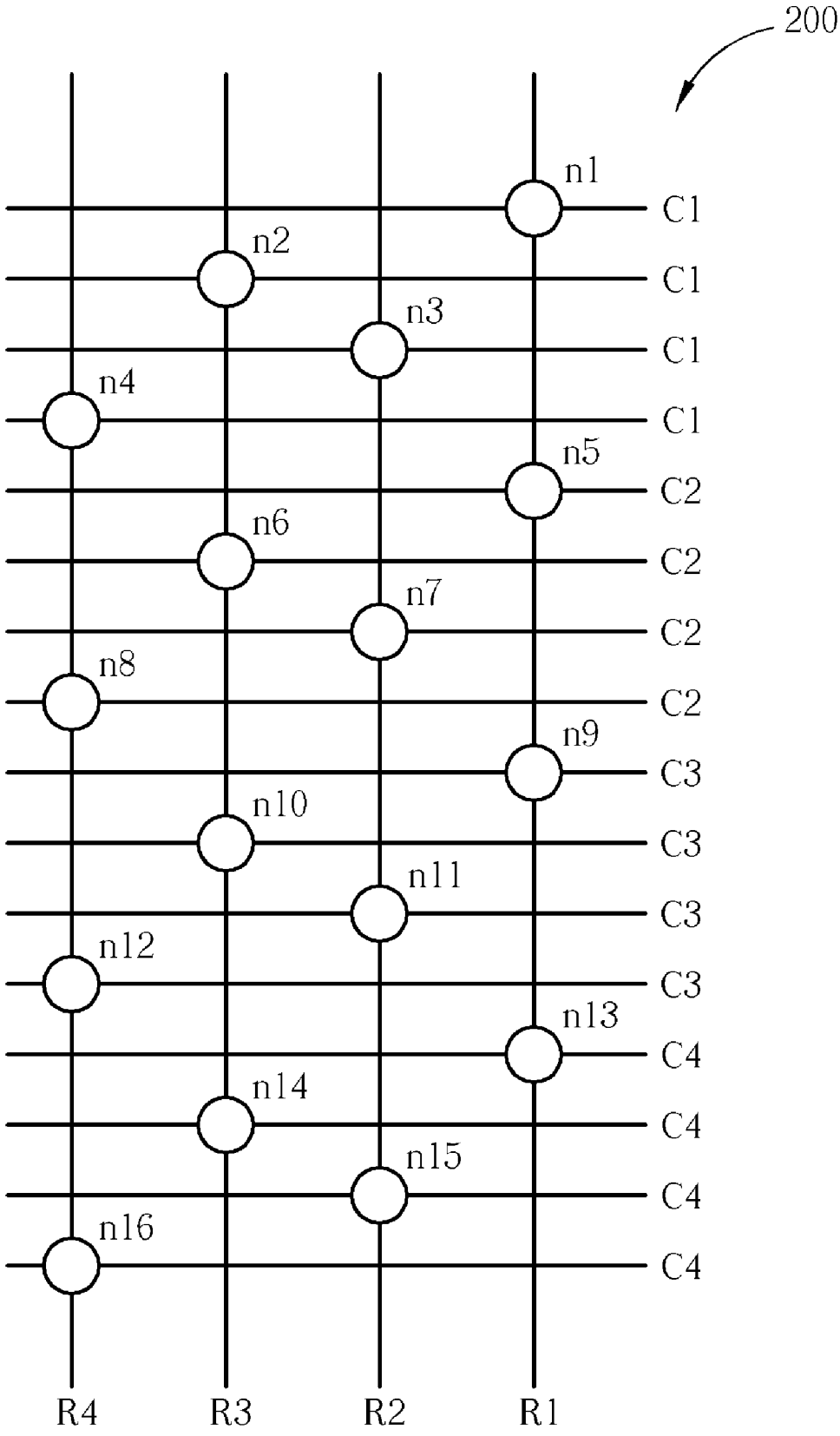
FIG. 8 is a print nozzle arrangement according to the present invention.

Please refer to FIG. 8. FIG. 8 is a print nozzle arrangement 200 according to the present invention. In FIG. 8, sixteen nozzles are shown, and are numbered n1-n16 for reference. The sixteen nozzles are arranged in a matrix of four rows and four columns, and each nozzle is uniquely identified by its row number and column number. Instead of utilizing all nozzles in the print nozzle arrangement 200 to eject ink at the same time, the present invention uses image masks to divide the original image into one or more sub-images.

Figure 9:
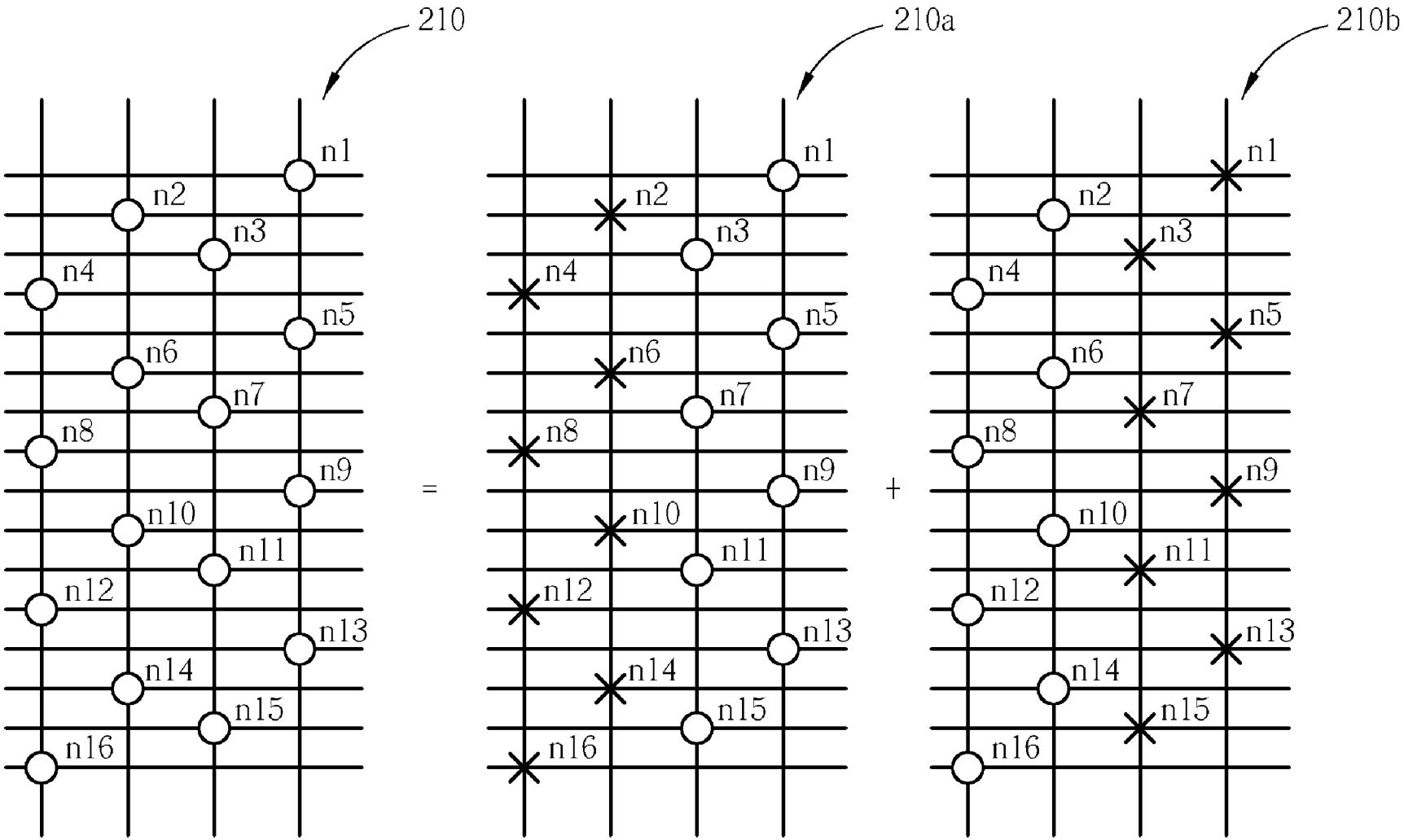
FIG. 9 illustrates a first algorithm used to generate image masks according to the present invention.

Please refer to FIG. 9. FIG. 9 illustrates a first algorithm used to generate image masks according to the present invention. An original image 210 is split into two sub-images through the use of a first mask 210*a* and a second mask 210*b*. In the first algorithm, every second nozzle is chosen to be in the first mask 210*a* and all remaining nozzles are then chosen for the second mask 210*b*. That is, the first mask 210*a* is used to eject ink only from nozzles n1, n3, n5, n7, n9, n11, n13, and n15. The second mask 210*b* ejects ink from the nozzles that were not chosen for the first mask 210*a*. The nozzles allowed to eject ink with the second mask 210*b* are n2, n4, n6, n8, n10, n12, n14, and n16. Although only two image masks are used to illustrate the first algorithm in FIG. 9, any number of image masks can be used as well. Suppose that M image masks are used, thereby producing M corresponding sub-images. A generalized rule for the first algorithm is as follows:

Step S10: Choose every $M^{th}$ nozzle to be included in a first mask;

Step S12: Repeat step S10 for selecting a second mask through an $(M-1)^{th}$ mask. Nozzles that were previously chosen to be included in other masks are not included in any additional masks; and Step S14: Choose all remaining nozzles to be included in an $M^{th}$ mask.

Figure 10:
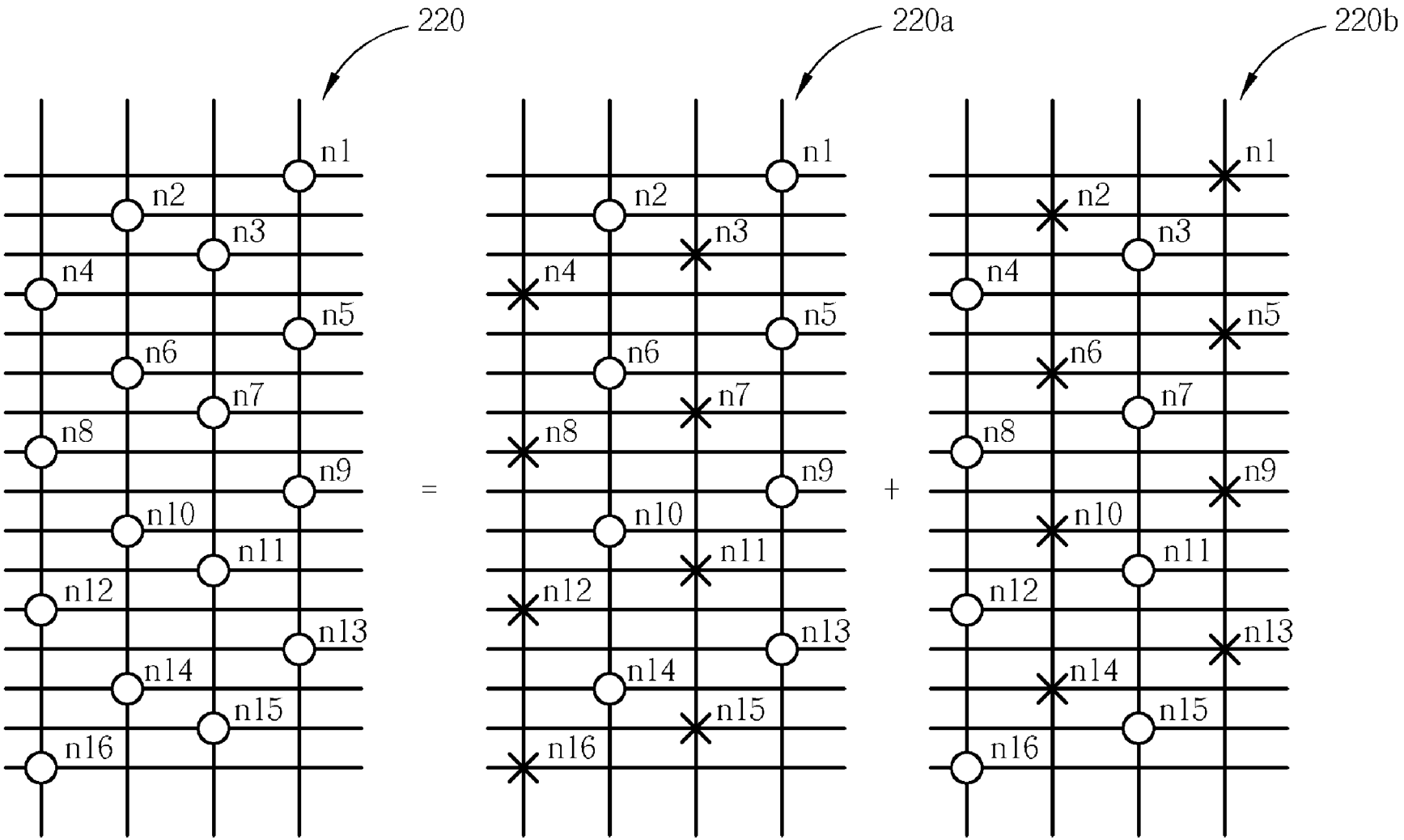
FIG. 10 illustrates a second algorithm used to generate image masks according to the present invention.

Please refer to FIG. 10. FIG. 10 illustrates a second algorithm used to generate image masks according to the present invention. An original image 220 is split into two sub-images through the use of a first mask 220*a* and a second mask 220*b*. In the second algorithm, contiguous groups of two nozzles are chosen to be included in the first mask 220*a*. Between every contiguous group of two nozzles chosen for the first mask 220*a* is a group of two contiguous nozzles not chosen to be in the first mask 220*a*. Therefore, the first mask 220*a* is used to eject ink only from nozzles n1, n2, n5, n6, n9, n10, n13, and n14. The second mask 220*b* ejects ink from the nozzles that were not chosen for the first mask 220*a*. The nozzles allowed to eject ink with the second mask 220*b* are n3, n4, n7, n8, n11, n12, n15, and n16. Although only two image masks are used to illustrate the second algorithm in FIG. 10, any number of image masks can be used as well. Suppose that M image masks are used, thereby producing M corresponding sub-images. A generalized rule for the second algorithm is as follows:

Step S20: Chose contiguous groups of N nozzles to be included in a first mask, where N is an integer greater than or equal to one. Each group of N nozzles included in the first mask is separated by (M−1)*N contiguous nozzles not included in the first mask;

Step S22: Repeat step S20 for selecting a second mask through an $(M-1)^{th}$ mask. Nozzles that were previously chosen to be included in other masks are not included in any additional masks; and Step S24: Choose all remaining nozzles to be included in an $M^{th}$ mask.

Figure 11:
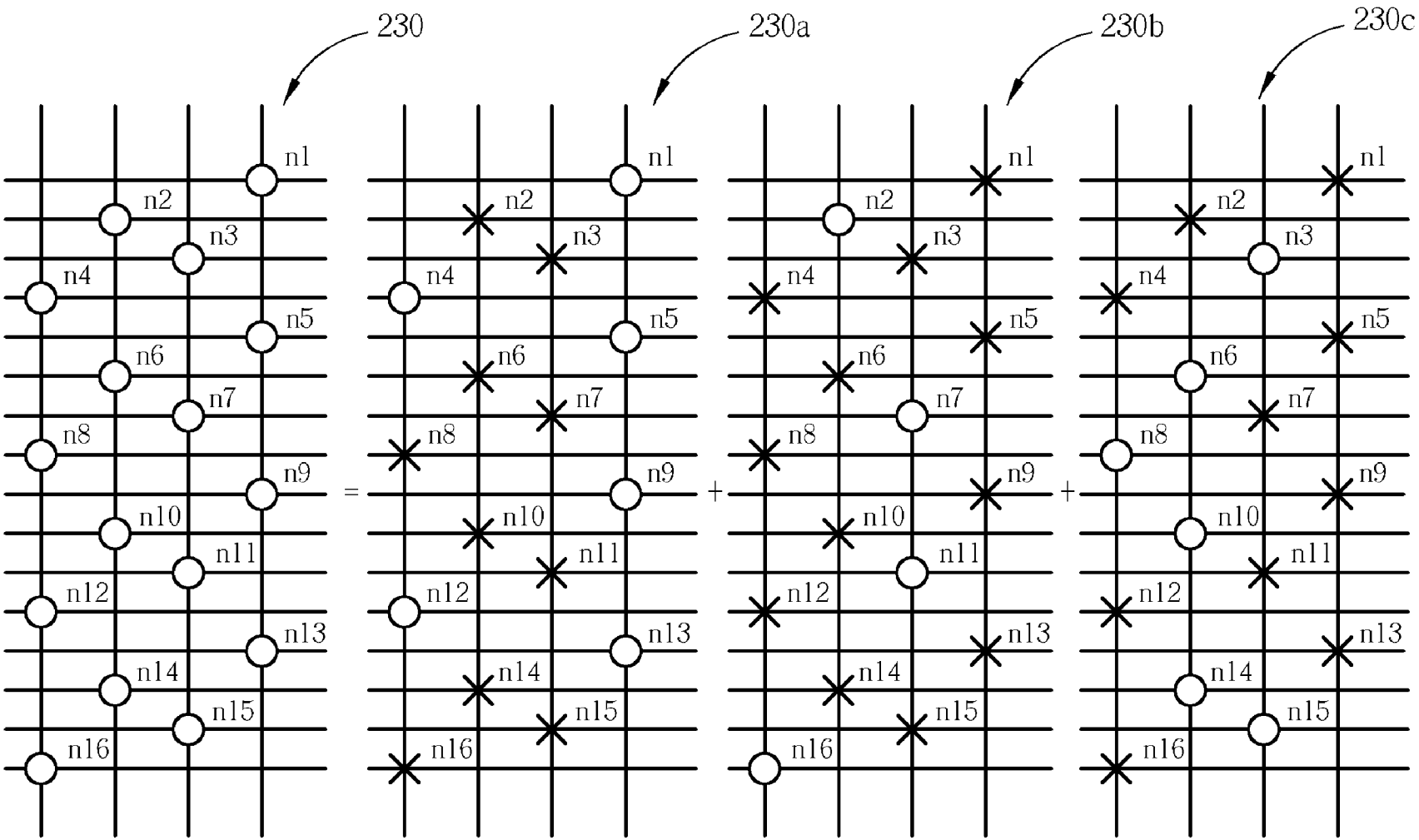
FIG. 11 illustrates a third algorithm used to generate image masks according to the present invention.

Please refer to FIG. 11. FIG. 11 illustrates a third algorithm used to generate image masks according to the present invention. An original image 230 is split into three sub-images through the use of a first mask 230*a*, a second mask 230*b*, and a third mask 230*c*. In the third algorithm, the scheme for generating each image mask is to choose nozzles that are spaced as far apart as possible. A specific explanation for the masks shown in FIG. 11 will be given first, followed by an explanation of the general case.

First Mask

1. A first nozzle n1 is chosen to be included in the first mask 230*a* (this nozzle can be any nozzle, and does not necessarily have to be nozzle n1).

2. The three nozzles n2, n3, n5 closest to nozzle n1 are analyzed.

3. Of the three nozzles n2, n3, n5, the nozzle n5 farthest from nozzle n1 is chosen to be included in the first mask 230*a*.

4. The three nozzles n6, n7, n9 closest to nozzle n5 are analyzed (only nozzles that have not already been chosen or analyzed for inclusion in the first mask 230*a* can be analyzed).

5. The nozzle n9 farthest from nozzle n5 is chosen to be included in the first mask 230*a*.

6. The three nozzles n10, n11, n13 closest to nozzle n9 are analyzed.

7. The nozzle n13 farthest from nozzle n9 is chosen to be included in the first mask 230*a*.

8. The three nozzles n12, n14, n15 closest to nozzle n13 are analyzed (again, only nozzles that have not already been chosen or analyzed for inclusion in the first mask 230*a* can be analyzed).

9. The nozzle n12 farthest from nozzle n13 is chosen to be included in the first mask 230*a*.

10. The three nozzles n4, n8, n16 are analyzed (these are the only three nozzles that have not been analyzed thus far).

11. The nozzle n4 farthest from nozzle n12 is chosen to be included in the first mask 230*a*.

After all of the nozzles have been chosen for the first mask 230*a*, only nozzles n1, n4, n5, n9, n12, and n13 can be used to eject ink with the first mask 230*a*.

Second Mask

The selection schemed used to choose nozzles for the second mask 230*b* is similar to that of the first mask 230*a*. The only difference is nozzles that have already been chosen for the first mask 230*a* are not analyzed for inclusion in the second mask 230*b*.

1. A first nozzle n2 is chosen to be included in the second mask 230*b* (again, this nozzle can be any remaining nozzle, and does not necessarily have to be nozzle n2).

2. The three nozzles n3, n6, n7 closest to nozzle n2 are analyzed.

3. Of the three nozzles n3, n6, n7, the nozzle n7 farthest from nozzle n2 is chosen to be included in the second mask 230*b*.

4. The three nozzles n8, n10, n11 closest to nozzle n7 are analyzed (nozzles that have already been chosen or analyzed for inclusion in the second mask 230*b* cannot be analyzed).

5. The nozzle n11 farthest from nozzle n7 is chosen to be included in the second mask 230*b*.

6. The three nozzles n14, n15, n16 closest to nozzle n11 are analyzed.

7. The nozzle n16 farthest from nozzle n11 is chosen to be included in the second mask 230*b*.

After all of the nozzles have been chosen for the second mask 230*b*, only nozzles n2, n7, n11, and n16 can be used to eject ink with the second mask 230*b*.

Third Mask

Since there are only three masks used in this example, the nozzles chosen for the third mask 230*c* are simply the nozzles that have not already been chosen for the first mask 230*a* or the second mask 230*b*. These nozzles include n3, n6, n8, n10, n14, and n15.

Although only three image masks are used to illustrate the third algorithm in FIG. 11, any number of image masks can be used as well. Suppose that M image masks are used, thereby producing M corresponding sub-images. A generalized rule for the third algorithm is as follows:

Step S30: Chose a current nozzle to be included in the first mask;

Step S32: Analyze a group of M nozzles closest to the current nozzle, wherein the group of M nozzles have not been previously chosen or analyzed for inclusion in the first mask;

Step S34: Select among the group of M closest nozzles a next nozzle that is farthest away from the current nozzle. Choose this next nozzle to be included in the first mask;

Step S36: Repeat steps S32 and S34 until all nozzles have been analyzed. Each next nozzle is treated as the current nozzle after the next nozzle has been chosen to be included in the first mask;

Step S38: Repeat steps S30 through S36 for selecting a second mask through an $(M-1)^{th}$ mask. Nozzles that were previously chosen to be included in other masks are not analyzed for inclusion in any additional masks; and Step S40: Choose all remaining nozzles to be included in an $M^{th}$ mask.

Since the nozzles used in each mask are chosen to be as far apart as possible in the third algorithm, negative effects from heat accumulation are minimized and printing quality is improved.

In summary, the present invention may be applied to any kind of ink jet printing device for improving the quality of printing. For example, the present invention is well suited for use in inkjet printers, inkjet facsimile machines, or inkjet copiers. Furthermore, according to the invention, data representative of images can be data representative of any kind of images or texts, such as black-and-while images, color images, text, gray-level text and images, or colorful text and images.

In contrast to the prior art, the present invention calculates a value of heat that will be generated when image data is printed. Instead of printing the original image, the present invention method utilizes a plurality of image masks to divide the original image into a plurality of sub-images. The sub-images are printed sequentially and superimposed on each other to print an image resembling the original image. Printing many sub-images instead of printing one large image prevents accumulated heat from negatively affecting ink temperature, and maintains the quality of printing.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method of printing an image on a printing medium with an inkjet printing device, the method comprising:

providing data representative of an original image;

calculating a total heat weighting value for the original image to indicate a degree of heat accumulation for the original image;

comparing the total heat weighting value to R distinct reference values, R being an integer greater than or equal to one;

selecting M image masks to be used to mask the original image, wherein a value of M is chosen according to comparison results between the total heat weighting value and the R reference values, M being an integer greater than or equal to one, a first image mask being generated by:

(b1) choosing contiguous groups of N nozzles to be included in a first mask, wherein each group of N nozzles included in the first mask is separated by (M−1)*N nozzles not included in the first mask, N being an integer greater than or equal to one;

masking the original image with the M image masks to produce M sub-images; and printing the M sub-images successively on the printing medium with a plurality of nozzles for superimposing the M sub-images on the printing medium, whereby the original image is printed on the printing medium.

2. The method of claim 1, wherein the second through $M^{th}$ masks are generated by:

(b2) repeating step (b1) for selecting a second mask through an $(M-1)^{th}$ mask, wherein nozzles that were previously chosen to be included in other masks are not included in any additional masks; and (b3) choosing all remaining nozzles to be included in an $M^{th}$ mask.

3. The method of claim 1 wherein selecting M image masks comprises reading the M image masks from a table memory.

4. The method of claim 1 wherein the total heat weighting value is calculated according to locations of the pixels to be printed and a heat weighting look-up table.

5. The method of claim 1 wherein the total heat weighting value is a sum of heat weighting values calculated for each row of nozzles contained in a printhead of the inkjet printing device.

6. The method of claim 5 wherein the total heat weighting value is calculated before each swath that the printhead makes over the printing medium.

7. The method of claim 1 wherein M is less than or equal to R+1.

8. The method of claim 1, wherein the inkjet printing device is an inkjet printer having a printhead comprising a plurality of nozzles to jet ink droplets on the printing medium so as to form the image on the printing medium.

9. The method of claim 1, wherein the data representative of the original image is gray-scale image data.

10. The method of claim 1, wherein the data representative of the original image is color image data.

11. A method of printing an image on a printing medium with an inkjet printing device, the method comprising:

providing data representative of an original image;

calculating a total heat weighting value for the original image to indicate a degree of heat accumulation for the original image;

comparing the total heat weighting value to R distinct reference values, R being an integer greater than or equal to one;

selecting M image masks to be used to mask the original image, wherein a value of M is chosen according to comparison results between the total heat weighting value and the R reference values, M being an integer greater than or equal to one, a first image mask being generated by:

(c1) choosing a current nozzle to be included in the first mask;

(c2) analyzing a group of M nozzles closest to the current nozzle, wherein the group of M nozzles have not been previously chosen or analyzed for inclusion in the first mask;

(c3) selecting among the group of M closest nozzles a next nozzle which is farthest away from the current nozzle, and choosing the next nozzle to be included in the first mask; and (c4) repeating steps (c2) and (c3) until all nozzles have been analyzed, wherein each next nozzle is treated as the current nozzle after the next nozzle has been chosen to be included in the first mask;

masking the original image with the M image masks to produce M sub-images; and printing the M sub-images successively on the printing medium with a plurality of nozzles for superimposing the M sub-images on the printing medium, whereby the original image is printed on the printing medium.

12. The method of claim 11, wherein the second through $M^{th}$ masks are generated by:

(c5) repeating steps (c1) through (c4) for selecting a second mask through an $(M-1)^{th}$ mask, wherein nozzles that were previously chosen to be included in other masks are not analyzed for inclusion in any additional masks; and (c6) choosing all remaining nozzles to be included in an $M^{th}$ mask.

13. The method of claim 11 wherein selecting M image masks comprises reading the M image masks from a table memory.

14. The method of claim 11 wherein the total heat weighting value is calculated according to locations of the pixels to be printed and a heat weighting look-up table.

15. The method of claim 11 wherein the total heat weighting value is a sum of heat weighting values calculated for each row of nozzles contained in a printhead of the inkjet printing device.

16. The method of claim 15 wherein the total heat weighting value is calculated before each swath that the printhead makes over the printing medium.

17. The method of claim 11 wherein M is less than or equal to R+1.

18. The method of claim 11, wherein the inkjet printing device is an inkjet printer having a printhead comprising a plurality of nozzles to jet ink droplets on the printing medium so as to form the image on the printing medium.

19. The method of claim 11, wherein the data representative of the original image is gray-scale image data.

20. The method of claim 11, wherein the data representative of the original image is color image data.

* * * * *